United States Patent [19]

Ebata et al.

[11] Patent Number: 4,511,089

[45] Date of Patent: Apr. 16, 1985

[54] NOZZLE HEADER FOR COOLING PLATES

[75] Inventors: Sadao Ebata; Seiji Bando, both of Kurashiki, Japan

[73] Assignee: Kawasaki Steel Corporation, Kobe, Japan

[21] Appl. No.: 509,957

[22] Filed: Jun. 30, 1983

[30] Foreign Application Priority Data

Jul. 7, 1982 [JP] Japan ..... 57-102917[U]

[51] Int. Cl.[3] ..... B05B 1/14

[52] U.S. Cl. ..... 239/553.3; 137/561 A

[58] Field of Search ..... 239/553.3, 553.5, 554, 239/547, 548, 567, 450; 137/561 A, 883, 886, 574, 576

[56] References Cited

U.S. PATENT DOCUMENTS

| | | | |
|---|---|---|---|
| 953,080 | 3/1910 | Wiggins | 239/450 |
| 2,884,205 | 4/1959 | Van Buren | 239/567 X |
| 3,447,755 | 6/1969 | Cartwright | 137/883 X |
| 4,023,621 | 5/1977 | Olson | 239/567 X |
| 4,253,247 | 3/1981 | Bergstrom | 137/883 X |
| 4,265,840 | 5/1981 | Bahler | 239/553 X |
| 4,398,355 | 8/1983 | Dove | 239/553.3 |

FOREIGN PATENT DOCUMENTS

| | | | |
|---|---|---|---|
| 147448 | 7/1952 | Australia | 239/553.3 |
| 2805172 | 8/1978 | Fed. Rep. of Germany . | |
| 2006647 | 5/1979 | United Kingdom | 239/553 |
| 2035526 | 6/1980 | United Kingdom . | |
| 309049 | 7/1971 | U.S.S.R. | 266/109 |
| 916065 | 3/1982 | U.S.S.R. | 164/144 |

*Primary Examiner*—Andres Kashnikow
*Assistant Examiner*—Kevin Patrick Weldon
*Attorney, Agent, or Firm*—Balogh, Osann, Kramer, Dvorak, Genova & Traub

[57] ABSTRACT

A nozzle header for cooling plates according to the invention comprises a lower cylindrical header to a lower header chamber therein and having cooling water supply means for supplying a cooling water into the lower header chamber, an upper header in the form of a roof mounted on the lower cylindrical header therealong to form an upper header chamber therein substantially triangular in section communicating with the lower header chamber through apertures formed in an upper wall of the lower cylindrical header, and nozzles extending through the lower header chamber and having upper ends communicating with the upper header chamber and lower ends in the form of nozzle outlets for jetting the cooling water against a surface to be cooled. The nozzle header can jet the cooling water with violent penetrating and stirring forces within an adjustable wide flow rate range to perform a sufficient cooling and can instantaneously stop the jetting cooling water at a desired time to obtain heat treated steel plates superior in quality.

5 Claims, 5 Drawing Figures

NOZZLE HEADER FOR COOLING PLATES

BACKGROUND OF THE INVENTION

1. Field of the Invention

This invention relates to a cooling device for heated steel plates and more particularly to an improvement of a nozzle header for cooling upper surfaces of plate materials.

2. Description of the Prior Art

It has been well known to improve steel properties such as mechanical properties by cooling the heated steel at a determined cooling speed. A continuous heat treatment method for cooling moving steel plates serves to improve productivity in a steel manufacturing line. Particularly, the continuous heat treatment of heated steel plates immediately after being rolled in a rolling mill line can dispense with heating of the steel plates for the heat treatment to provide great merits in economy of energy and improvement of productivity, and simultaneously can possibly improve the material quality by the heat treatment in conjunction with the working in rolling. Recently, the heat treatment in the rolling mill line has been earnestly investigated, in order to obtain a cooling device easily controlled and having an adjustable wide cooling performance.

In general, cooling devices for heated steel plates will encounter a difficulty in removing cooling water on the steel plates to be cooled. The remaining cooling water frequently forms a water layer more than 50–60 mm in depth. In order to effectively cool the upper surfaces of the steel plate, therefore, the cooling water should be strongly penetrated into such a thick water layer so as to directly reach the surfaces of the plates or the remaining water on the plates should be violently stirred or agitated by the cooling water jetted from the cooling devices.

On the other hand, the cooling device for cooling heated steel plates, particularly cooling surfaces of the plates should be arranged as high as possible above the plates in order to avoid an occurrence of scratch on the plates or damage of the cooling device when it moves above the plates, due to a contact therebetween owing to, for example, a deformation of the plates. Accordingly, it is necessary to increase a concentric velocity or density of the cooling water jetting from the cooling device at the surface of the plate for the purpose of fulfiling the condition of the strong penetration or violent agitation required for the cooling device as above described.

Moreover, it is desired for the cooling device to be able to stop jetting cooling water instantaneously, when required, in order to control the temperature at the end of cooling to obtain high quality steel plates.

A nozzle header 60 as shown in FIG. 1 has been proposed. However, it cannot stop jetting cooling water from the header if required, because a volume $S_1'$ of the cooling water in the header 60 above an upper end of a nozzle 4' is fairly large, which would delay a complete stoppage of the cooling water after the water supply to the header 60 has been shut off. This header 60, moreover, cannot achieve uniform cooling of plates because the cooling water exclusively flows in its longitudinal direction so as to be unequally distributed into nozzles.

SUMMARY OF THE INVENTION

It is a primary object of the invention to provide an improved nozzle header which fulfils all the conditions required for the cooling device as above described and is simple in construction and inexpensive to manufacture.

It is still more specific object of the invention to provide a nozzle header which can jet the cooling water with violent penetrating and stirring forces within an adjustable wide flow rate range to perform a sufficient cooling, even if a great amount of cooling water remains on an upper surface of the plate, and which can instantaneously stop the jetting cooling water at a desired time to obtain heat treated steel plates superior in quality.

In order to achieve the above objects, a nozzle header according to the invention comprises a lower cylindrical header to form a lower header chamber therein and having cooling water supply means for supplying a cooling water into said lower header chamber, an upper header in the form of a roof mounted on said lower cylindrical header therealong to form an upper header chamber therein substantially triangular in section with an upper wall of said lower cylindrical header, said upper wall being formed with communicating apertures for communicating said lower and upper header chambers, and nozzles extending through said lower header chamber and having upper ends communicating with said upper header chamber and lower ends forming nozzle outlets for jetting said cooling water against a surface to be cooled.

In a preferred embodiment of the invention, the upper header and nozzles are made in a relation $0.5 \leqq S_2/S_1 \leqq 4$ where $S_1$ is a vertical cross-sectional area of an upper corner space in the upper header chamber above the upper ends of the nozzles and $S_2$ is a horizontal cross-sectional area of the nozzle, and the nozzles are sized in a relation $L/d \geqq 5$, where L is an overall length of the nozzle and d is an inner diameter of the nozzle.

The invention will be more fully understood by referring to the following detailed specification and claims taken in connection with the appended drawings.

DETAILED DESCRIPTION OF THE PREFERRED EMBODIMENT

Figure 1:
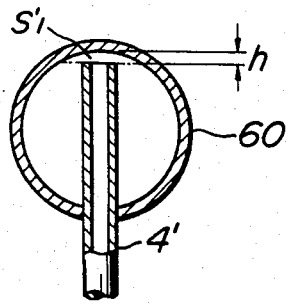
FIG. 1 PRIOR ART
FIG. 1 is a sectional view of a nozzle header of the prior art as above mentioned.
Figure 2:
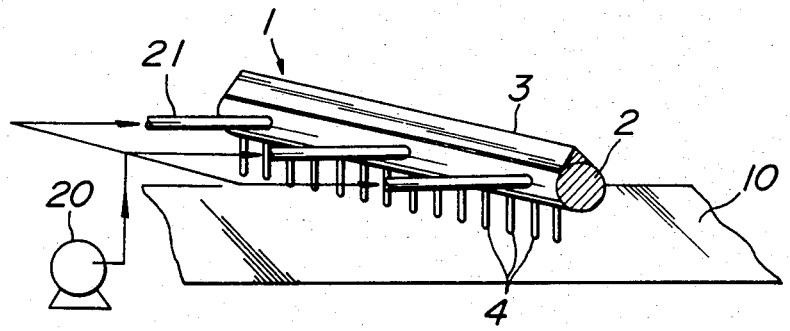
FIG. 2 is a schematic perspective view of a nozzle header according to the invention.
Figure 3:
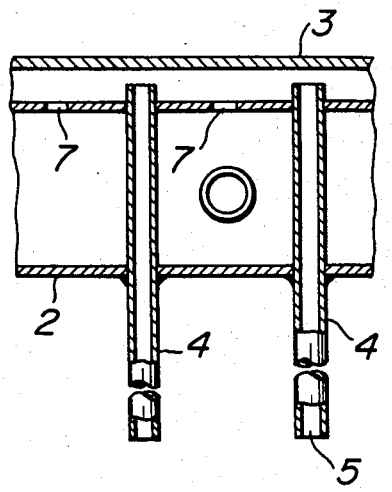
FIG. 3 is a partial vertical sectional view of the nozzle header shown in FIG. 2.
Figure 4:
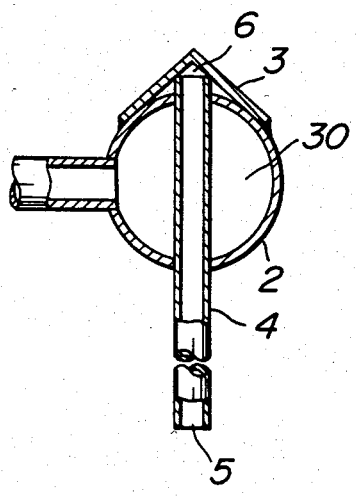
FIG. 4 is a partial cross-sectioanl view of the nozzle header shown in FIG. 2.

Referring to FIGS. 2–5 illustrating one embodiment of the invention, a nozzle header 1 comprises a lower header 2 to form a lower header chamber therein, an upper header 3 in the form of a roof mounted on the lower header therealong to form an upper header chamber therein substantially triangular in section with an upper wall of the lower header, and a plurality of tubular nozzles 4 extending through the lower header 2 and having their upper ends communicating with the upper header chamber in the upper header and their lower ends formed as nozzle outlets 5 for jetting cooling water against a surface 10 of a plate to be cooled.

The cooling water 30 supplied from a water supply source 20 is fed through water supply piping 21 into the lower header 2 and through a plurality of openings 7 formed in an upper wall of the lower header 2 into the upper header chamber in the upper header 3. The cooling water 30 in the upper header 3 is then fed into the nozzles 4 through their upper ends and is jetted through the nozzle outlets 5 against the surface 10 to be cooled.

As above described, the nozzle header 1 according to the invention comprises the upper header 3 having a triangular cross-section and the nozzles 4 whose upper ends are inserted into the upper header to an extend such that parts of the upper edges of the nozzles 4 are in contact with inner walls of the triangular upper header 3 to make it easy to position the nozzles in assembling the nozzle header 1.

Moreover, when it is required to stop the jetting of the cooling water 30, the water can be immediately stopped by shutting off the water supply to the lower header 2 in a manner that the cooling water 30 in the nozzle 4 falls onto the surface of the plate 10 to be cooled and the cooling water 30 in an upper corner space 6 in the upper header 3 jets out of the nozzles 4 to such air into the space 6 in place of the jetted water.

Figure 5:
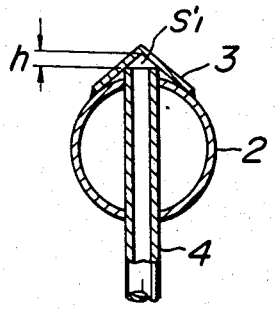
FIG. 5 is a cross-sectional view of the nozzle header according to the invention for explaining it in comparison with the nozzle header of the prior art shown in FIG. 1.

This will be explained in more detail referring to FIGS. 1 and 5. Assuming that a vertical height h between the uppermost line in the space in the header 60 and the upper end of the nozzle 4' of the nozzle header 60 of the prior art shown in FIG. 1 is equal to that of the nozzle header 1 according to the invention, the volume $S_1'$ in the space in the header 60 above the upper end of the nozzle 4' is more than two times of that in the nozzle header according to the invention. Accordingly, the time for the jetting of the cooling water from the nozzles 4' after the water supply to the header 60 has been shut off is longer in proportional to the increased volume in the space in the header 60 above the upper end of the nozzle 4'. It is clearly evident therefore that the jetting of the cooling water from the nozzles 4' is not immediately stopped.

With the nozzle header 60 of the prior art as shown in FIG. 1, moreover, as the cooling water flows in the header 60 in its axial direction, the amounts of cooling water jetting from the respective nozzles 4' arranged along the header 60 are greatly different to an extent such that uniform cooling of plates is obstructed.

In contrast herewith, with the nozzle header according to the invention, the cooling water supplied into the lower header 2 is fed through the openings 7 in the wall of the lower header 2 into the upper header 3 and then into the upper ends of the nozzles 4. The cooling water flow in the upper header 3 in its axial direction is very small, so that it is possible to make uniform the amounts of the cooling water jetting from the respective nozzles 4 so as to achieve the uniform cooling of a plate.

Dimensions of the principal parts of the nozzle header according to the invention will be explained hereinafter. As above described, it is desired to make the volume in the space in the header 3 above the upper end of the nozzles 4 as small as possible in order to immediately stop the cooling water jetting from the nozzles 4. In consideration of the amount of the cooling water entering into the nozzles through their upper ends, however, it is not preferable to make the sectional area $S_1$ of the upper corner space 6 extremely small.

The inventors of this application have made an experiment on this problem to find that when a ratio of a horizontal cross-sectional area $S_2$ of one nozzle 4 to the vertical cross-sectional area $S_1$ of the upper corner space 6 in the upper header 3 above the upper ends of the nozzles 4 is in a relation $0.5 \leqq S_2/S_1 \leqq 4$, the rapid stoppage of the jetting cooling water and stable cooling water jetting can be achieved.

A length of the nozzles is of course longer than an outer diameter of the lower header 2. When an inner diameter d and an entire length L of the nozzle 4 are in a relation $L/d \geqq 5$, the stable cooling water jetting can be generally obtained.

Furthermore, a cooling water pressure in the nozzle header 1 according to the invention is preferably a statical pressure higher than 0.5 $kg/cm^2G$ in the upper nozzle header in order to penetrate the jetting cooling water into or stirring the residual or remaining water on the surface of the plate to be cooled.

As can be seen from the above description, the nozzle header according to the invention can jet the cooling water in the form of water columns or rods having violent penetrating and stirring forces under a stable jetting condition within an adjustable wide flow rate range of the cooling water, even if a great amount of cooling water remains on an upper surface of a steel plate in cooling it. Moreover, the nozzle header according to the invention can instantaneously stop the jetting cooling water at a desired time, so that heat treated steel plates superior in quality can be produced with high efficiency.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A nozzle header comprising a lower cylindrical header to form a lower header chamber therein and having cooling water supply means for supplying a cooling water into said lower header chamber, an upper header in the form of a roof mounted on said lower cylindrical header therealong to form an upper header chamber therein substantially triangular in section with an upper wall of said lower cylindrical header, said upper wall being formed with communicating apertures for communicating said lower and upper header chambers, and nozzles extending through said lower header chamber and having upper ends communicating with said upper header chamber and lower ends forming nozzle outlets for jetting said cooling water against a surface to be cooled.

2. A nozzle header as set forth in claim 1, wherein said nozzles extend diametrically through said lower cylindrical header, and upper ends of said nozzles extending into said triangular upper header chamber are partially in contact with inner walls of said upper roof-shaped header.

3. A nozzle header as set forth in claim 1, wherein said nozzles are arranged at substantially equal intervals and said communicating apertures formed in said upper wall of said lower header are arranged at least one respectively between said nozzles.

4. A nozzle header as set forth in claim 1, wherein said upper header and nozzles are made in a relation $0.5 \leqq S_2/S_1 \leqq 4$ where $S_1$ is a vertical cross-sectional area of an upper corner space in said upper header chamber above said upper ends of said nozzles and $S_2$ is a horizontal cross-sectional area of said nozzle.

5. A nozzle header as set forth in claim 1, wherein said nozzles are sized in a relation $L/d \geqq 5$, where L is an overall length of said nozzle and d is an inner diameter of said nozzle.

* * * * *